US007721778B2

(12) United States Patent
Hess

(10) Patent No.: US 7,721,778 B2
(45) Date of Patent: May 25, 2010

(54) CONVERTIBLE LAPTOP BAG

(75) Inventor: Michael Hess, Pittsford, NY (US)

(73) Assignee: Three Point Ventures, LLC, Rochester, NY (US)

( * ) Notice: Subject to any disclaimer, the term of this patent is extended or adjusted under 35 U.S.C. 154(b) by 848 days.

(21) Appl. No.: 11/400,877

(22) Filed: Apr. 10, 2006

(65) Prior Publication Data

US 2006/0228052 A1 Oct. 12, 2006

Related U.S. Application Data

(60) Provisional application No. 60/670,173, filed on Apr. 11, 2005.

(51) Int. Cl.
*A45C 13/34* (2006.01)

(52) U.S. Cl. ..... 150/119; 383/14; 383/10; 383/86.2

(58) Field of Classification Search ..... 383/10, 383/98, 86, 14; 150/107, 108, 119
See application file for complete search history.

(56) References Cited

U.S. PATENT DOCUMENTS 1,604,658 A * 10/1926 Post ..... 383/2
1,826,976 A * 10/1931 Wright ..... 190/117
3,130,111 A * 4/1964 Izumi ..... 428/92
3,265,168 A * 8/1966 Erhard ..... 16/438
4,240,480 A * 12/1980 Strobel ..... 383/15
4,592,091 A * 5/1986 Italici ..... 383/15
6,053,634 A * 4/2000 Kay ..... 383/4

* cited by examiner

*Primary Examiner*—Tri M Mai
(74) *Attorney, Agent, or Firm*—Nixon Peabody LLP

(57) ABSTRACT

The present invention relates to a convertible bag for carrying a laptop that can be converted from a tote configuration to a skin or sleeve configuration and back again. The convertible bag includes a body that is shaped and configured to receive a laptop computer; a pair of handles connected to the body, each handle defining an aperture that is sized to receive a hand or a portion thereof; and at least three fasteners, one fastener attached to each handle and one fastener attached to the body, whereby two or more of the at least three fasteners are positioned to engage one another when the pair of handles are in a first position that exposes the apertures and when the pair of handles are in a second position folded against the body.

10 Claims, 6 Drawing Sheets

CONVERTIBLE LAPTOP BAG

This application claims the priority benefit of U.S. Provisional Patent Application Ser. No. 60/670,173, filed Apr. 11, 2005, which is hereby incorporated by reference in its entirety.

FIELD OF THE INVENTION

The present invention relates to a simple, minimalist laptop bag that has, as its key feature, the ability to convert from a tote bag to a protective sleeve in what is believed to be a new and unique fashion.

BACKGROUND OF THE INVENTION

Most laptop computer bags are equipped to carry a number of accessories, but when no such accessories are needed the bags essentially become excess weight. At the same time, most laptop computer sleeves are ill-equipped to carry much more than accessories and a few papers. When carrying books or traveling for business, it may be desirable to simply carry one's laptop in another, general-purpose bag and thereby avoid carrying two bags. It is believed that no laptop computer bag can satisfy both of these needs.

The present invention is intended to overcome these deficiencies in the art by providing a laptop computer bag that has two alternative uses, one as a tote and the other as a skin (or sleeve).

SUMMARY OF THE INVENTION

The present invention relates to a convertible bag for carrying a laptop that can be converted from a tote configuration to a skin or sleeve configuration and back again. The convertible bag includes a body that is shaped and configured to receive a laptop computer; a pair of handles connected to the body, each handle defining an aperture that is sized to receive a hand or a portion thereof; and at least three fasteners, one fastener attached to each handle and one fastener attached to the body, whereby two or more of the at least three fasteners are positioned to engage one another when the pair of handles are in a first position that exposes the apertures and when the pair of handles are in a second position folded against the body.

Preferably, the convertible bag includes: a body that has first and second panels that are joined together, and has an opening along one edge thereof, a first handle connected to the first panel of the body and a second handle connected to the second panel of the body, each handle defining an aperture; and at least three fasteners, one fastener attached to each handle and one fastener attached to the second panel of the body, whereby two or more of the at least three fasteners are positioned to engage one another when (i) the pair of handles are in a first position that exposes the apertures of the handles and (ii) the pair of handles are in a second position with the second handle tucked into the opening and the first handle folded over the second handle and against the second panel of the body.

As noted above, the present invention affords a laptop computer bag that has two alternative uses, one as a tote and the other as a skin (or sleeve). Because the carrying bag of the present invention is convertible between these two different configurations, the carrying bag can satisfy the above-noted needs in the art. Importantly, when used in the tote configuration and when used in the sleeve configuration, the present invention provides much-needed protection for the enclosed laptop computer while allowing the user the flexibility of carrying a minimal amount of material (computer accessories, other electronics, papers, etc.) and/or for carrying the encased and protected laptop computer within another bag.

DETAILED DESCRIPTION OF THE INVENTION

Figure 1:
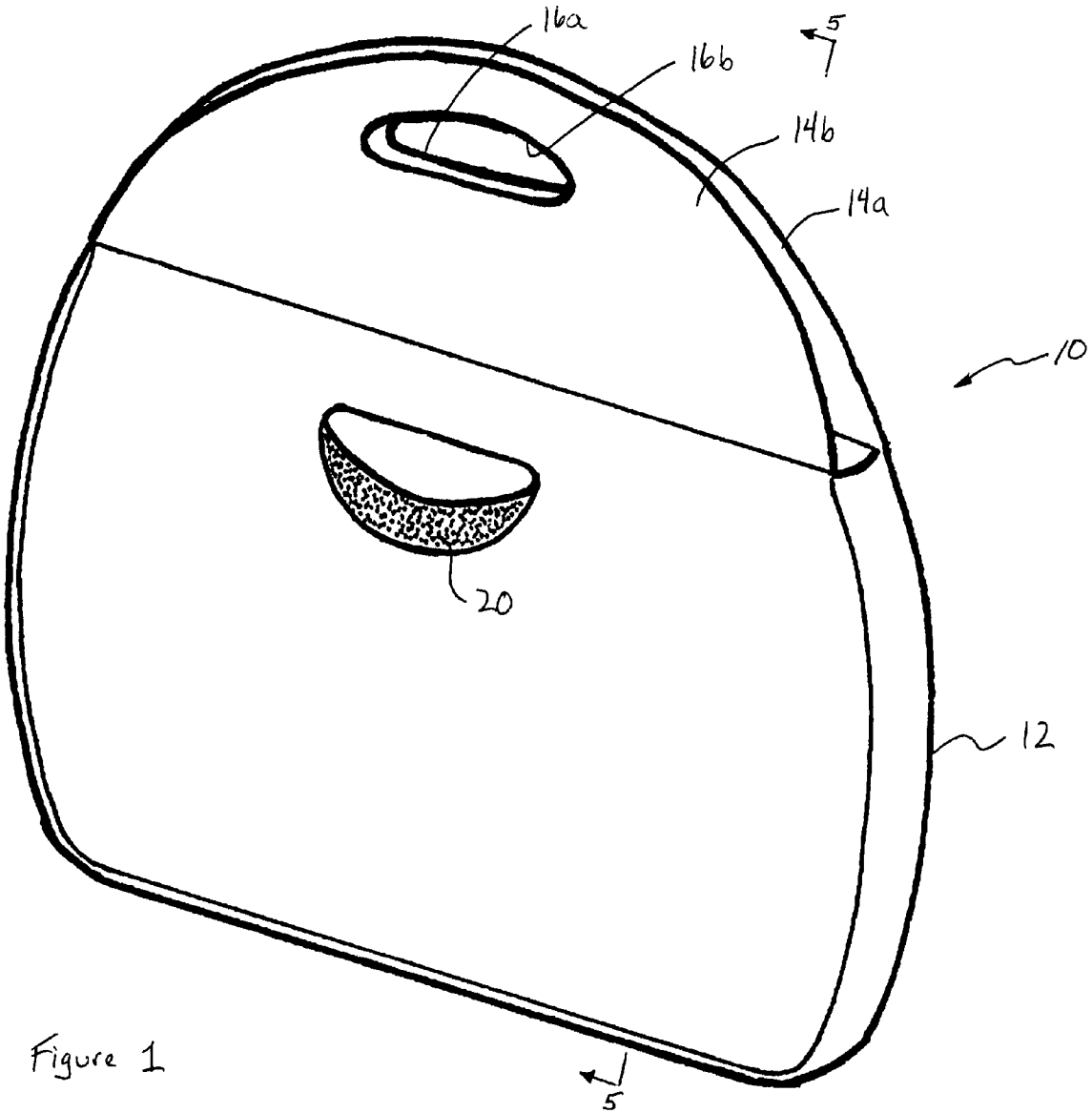
FIG. 1 is a perspective view of a convertible bag according to a first embodiment of the present invention. The bag is shown in the tote configuration.

The convertible bag of the present invention is characterized by a body that is shaped and configured to receive a laptop computer, a pair of handles that are integral with or connected to the body, with each handle defining an aperture that is suitably sized to receive a user's hand, and at least three fasteners that can secure the handles in one of two positions. Specifically, the handles can be joined together by two of the at least three fasteners to secure the handles in a first position (i.e., in a tote configuration), or one of the handles can be joined with the body by two of the at least three fasteners to secure the handles in a second position (i.e., in a sleeve configuration).

Preferably the body has first and second panel (i.e., front and back sides) that are joined together, and an opening along one edge (i.e., the top) through which a laptop computer can be inserted and removed. The pair of handles is connected to the first and second panels of the body such that they are positioned opposite one another across the opening. The fasteners on the two handles mate to join the handles together while they are in the first position (i.e., the tote configuration). A fastener is also attached to exterior of the second panel of the body. A fastener on the first handle mates with the fastener attached to the exterior of the second panel of the body when the second handle is folded through the opening (and tucked into the bag), and the first handle is folded over the exposed portion of the second handle and against the exterior of the second panel of the bag.

Exemplary fasteners include, without limitation, hook and loop fasteners, male and female snap fasteners, other mechanical fasteners, and magnetic fasteners.

Referring now to FIGS. 1-4, according to one embodiment the bag 10 is shown in its conversion from the tote configuration to the sleeve configuration. The bag 10, as described above, includes a body 12, first and second of handles 14*a*, 14*b* that define openings 16*a*, 16*b*, and three fasteners 18, 19, and 20. Fastener 18 is connected to handle 14*a*, fastener 19 is connected to handle 14*b*, and fastener 20 is connected externally of body 12. Fasteners 18 and 19 are connected to the handles 14*a*, 14*b* such that they engage one another to secure the handles in the first position (i.e., tote configuration) with the two handles confronting one another and openings 16*a*, 16*b* aligned to receive a user's hand. Fastener 20 is connected externally of body 12 such that fasteners 18 and 20 engage one another to secure the handles in the second position (i.e., sleeve configuration). In the second position, the openings 16*a*, 16*b* are obstructed.

Figure 2:
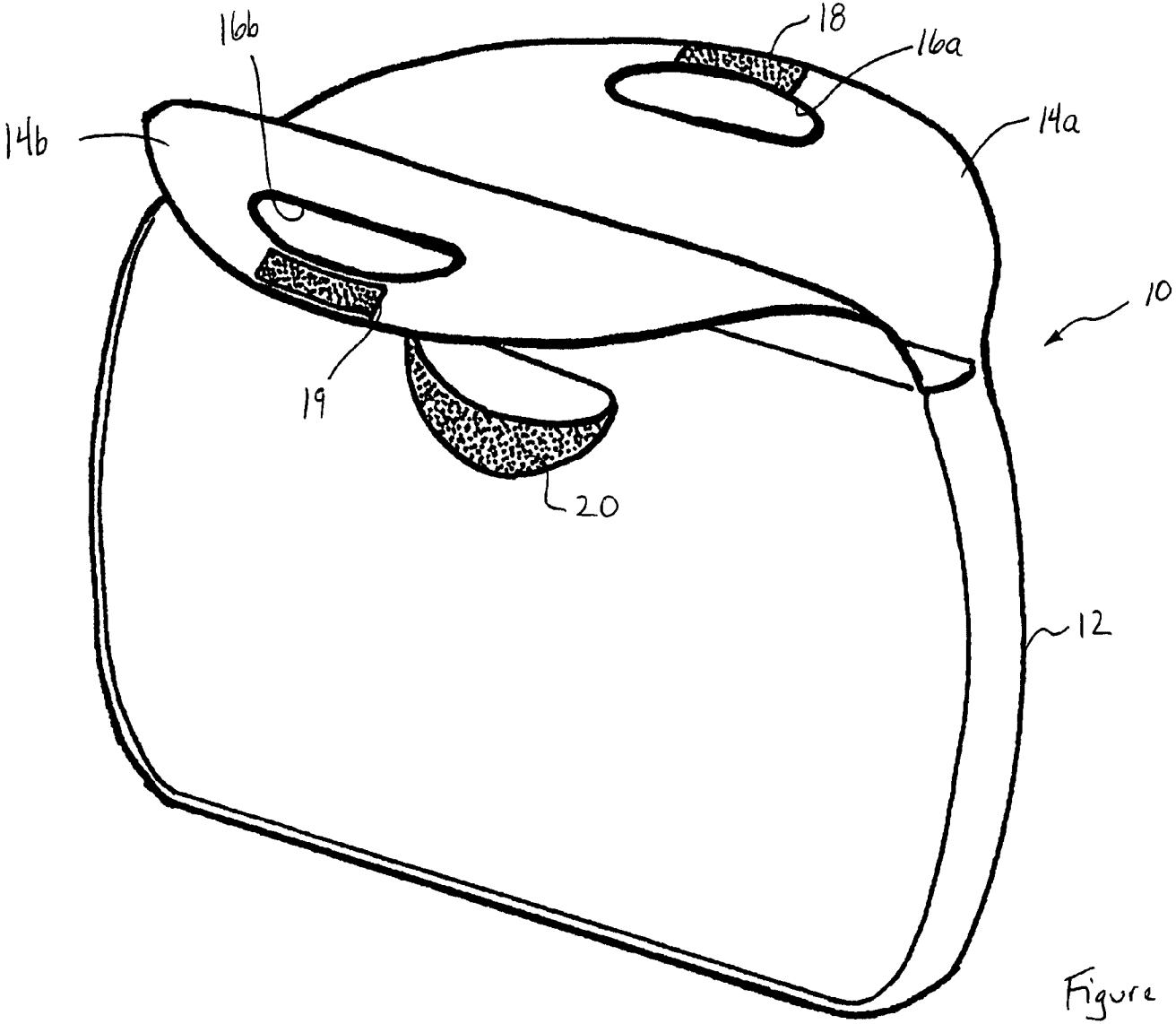
FIG. 2 is a perspective view of the first embodiment, with the handles unfastened, exposing mating fasteners on the handles and the body.
Figure 3:
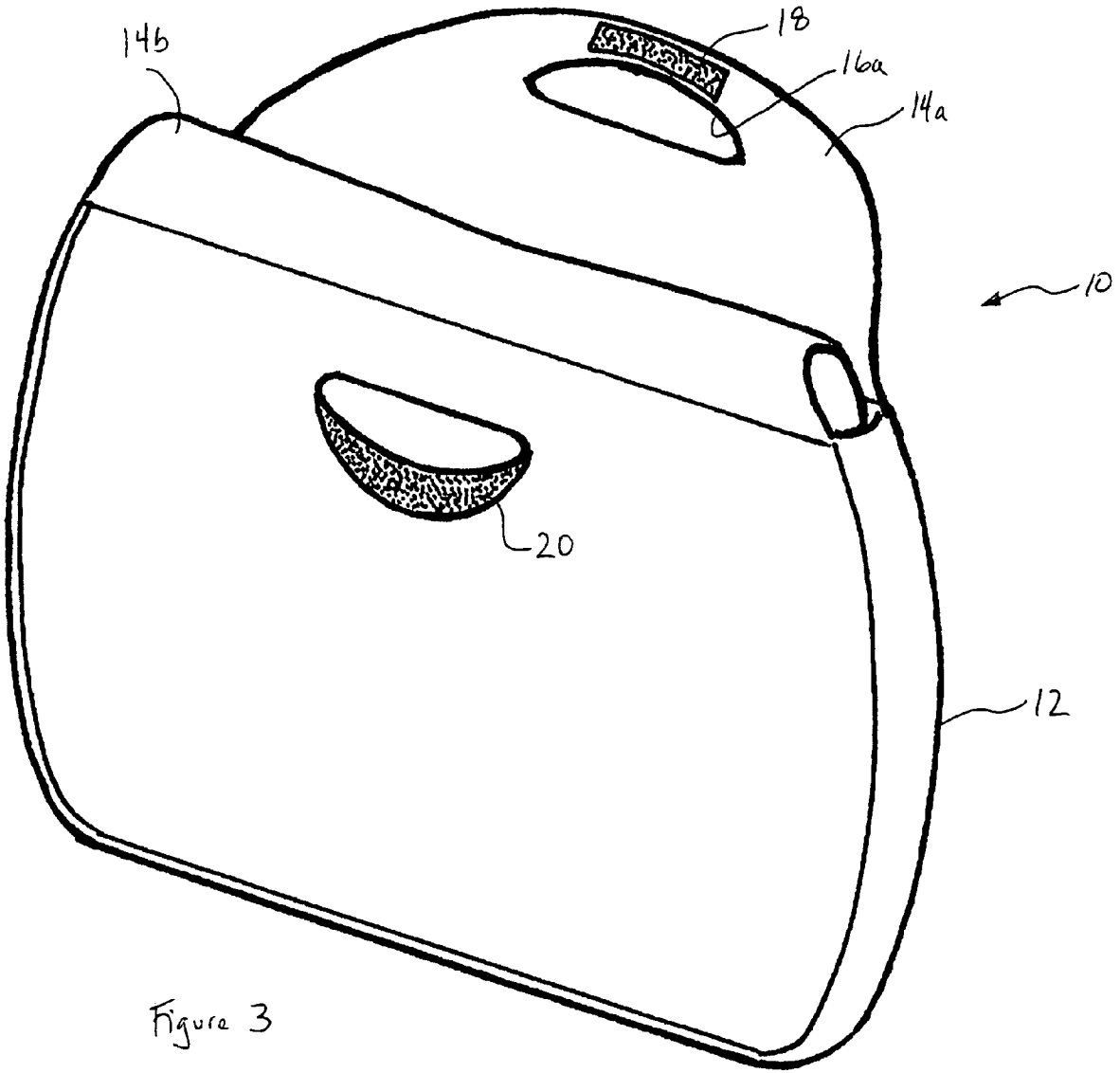
FIG. 3 is a perspective view of the first embodiment with one handle inserted into the body (as one step in the conversion to a sleeve configuration).
Figure 4:
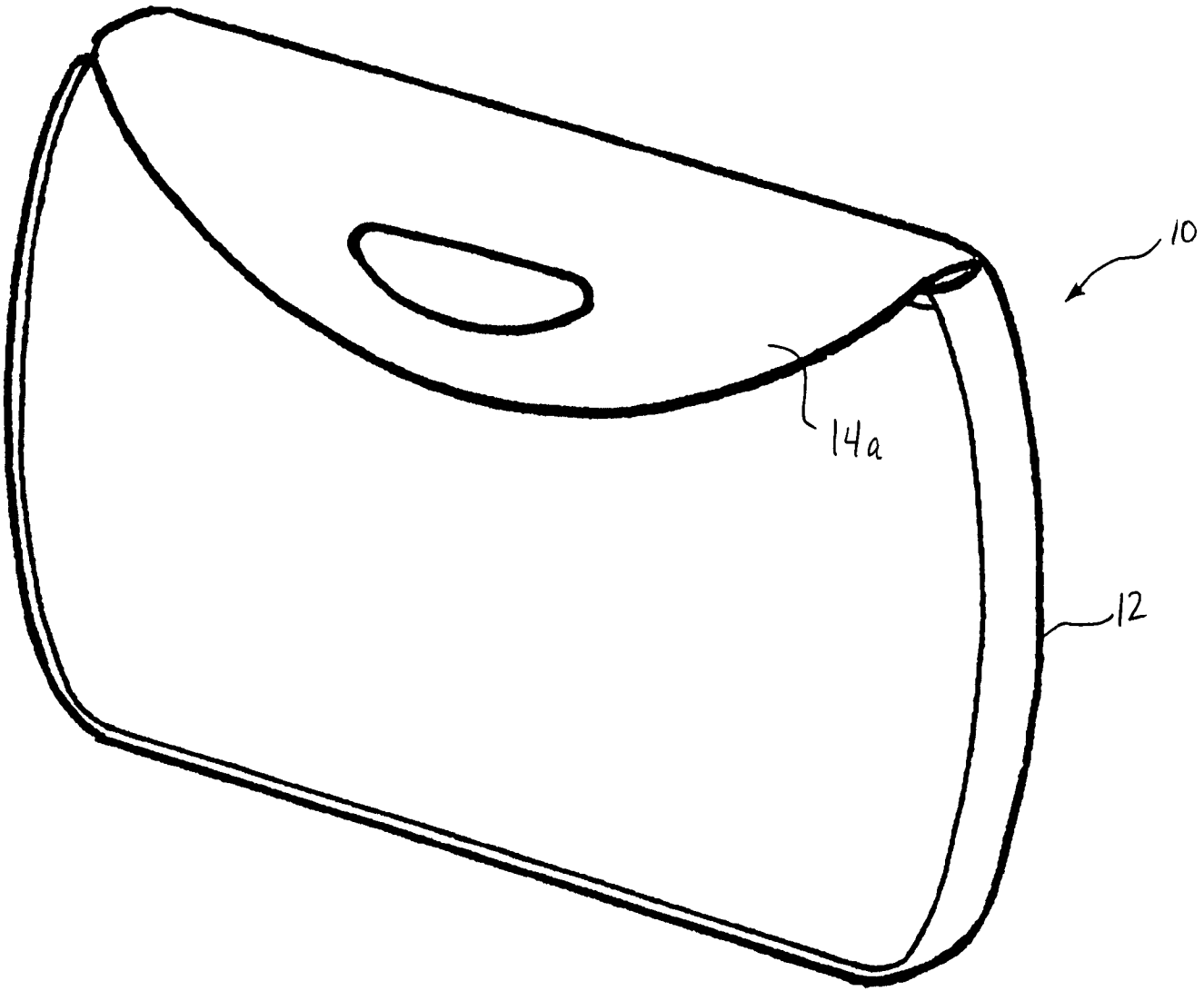
FIG. 4 is a perspective view of the first embodiment with the bag shown in the sleeve configuration.

The bag 10 can be converted from the first position (FIG. 1) to the second position (FIG. 4) by first disengaging fasteners 18 and 19, which allows the two handles to move freely of one another (FIG. 2). Then handle 14*b* is tucked between a laptop and the side of the bag to which the other handle 14*a* is connected (FIGS. 2 and 3). At this point, handle 14*a* can be folded over handle 14*b* and the side of the bag to which handle 14*b* is connected (FIG. 4). With fasteners 18 and 20 engaged in this configuration, the handle 14*a* is secured in the second position (FIG. 4).

In this embodiment, fastener 18 mates with each of fasteners 19 and 20. Thus, fasteners 19 and 20 are the same type of fastener, and fastener 18 is a corresponding mate thereof.

Figure 5:
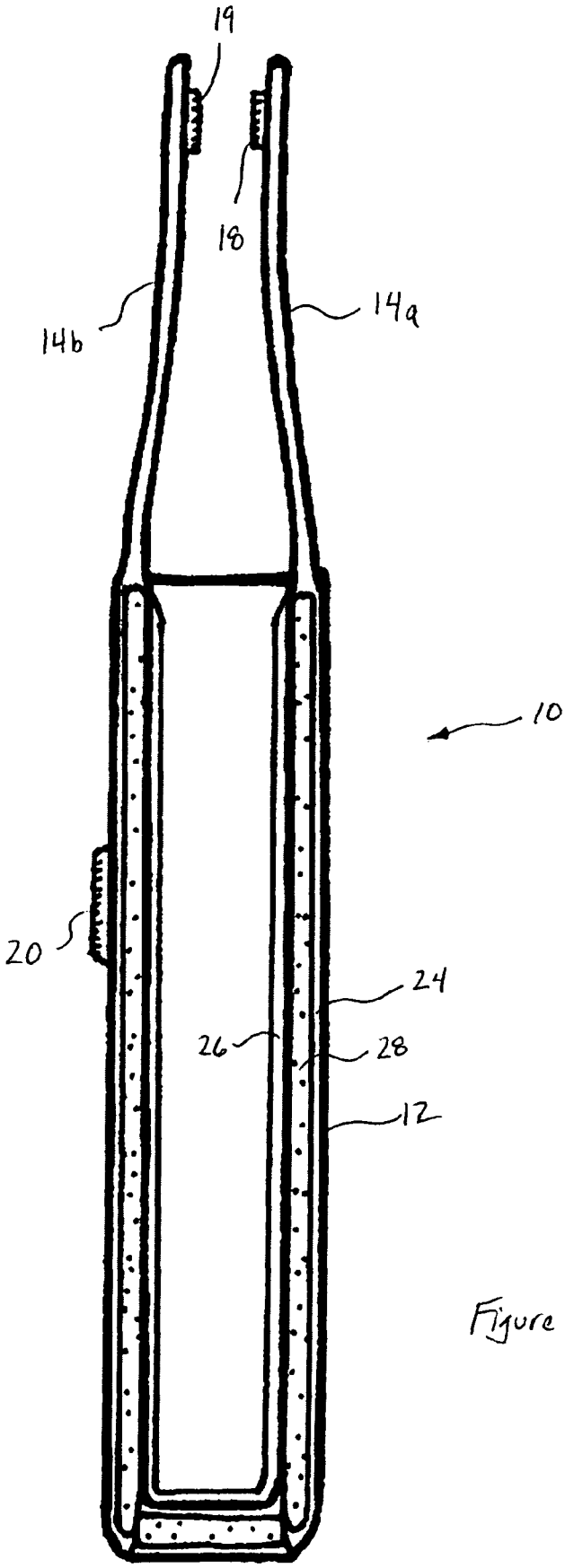
FIG. 5 is a cross-sectional view of the first embodiment taken along line 5-5 of FIG. 1.

As shown in FIG. 5, the bag 10 is preferably characterized by the presence of a durable outer layer 24, an inner lining 26, and a layer of padding 28. The bag 10 can be formed of any suitable material, the selection of which will largely depend upon non-functional aspects, such as style and fashion. For example, outer layer 24 is preferably formed of synthetic or natural products such as ballistic nylon, leather, canvas, or suede. The padding and lining materials can be selected from known materials. One preferred inner lining 26 material is a light-weight nylon, such as 420 Denier pack cloth. The padding is preferably an open or closed cell foam material, such as ETHAFOAM® (Dow Chemical Co.) or sponge foam.

The bag and handles can be formed from the same blank of material or they can be connected together during construction and assembly via stitching, heat welding, or other appropriate means.

Construction of the bag can be carried out using a continuous side and bottom panel, which is secured to the body panels along the length thereof (forming an opening between the body panels). If the handles are not integrally formed with the body panels, the handles can be connected to respective body panels on either side of the opening. Any of a wide variety of finishing materials can be applied to the seams.

Figure 6:
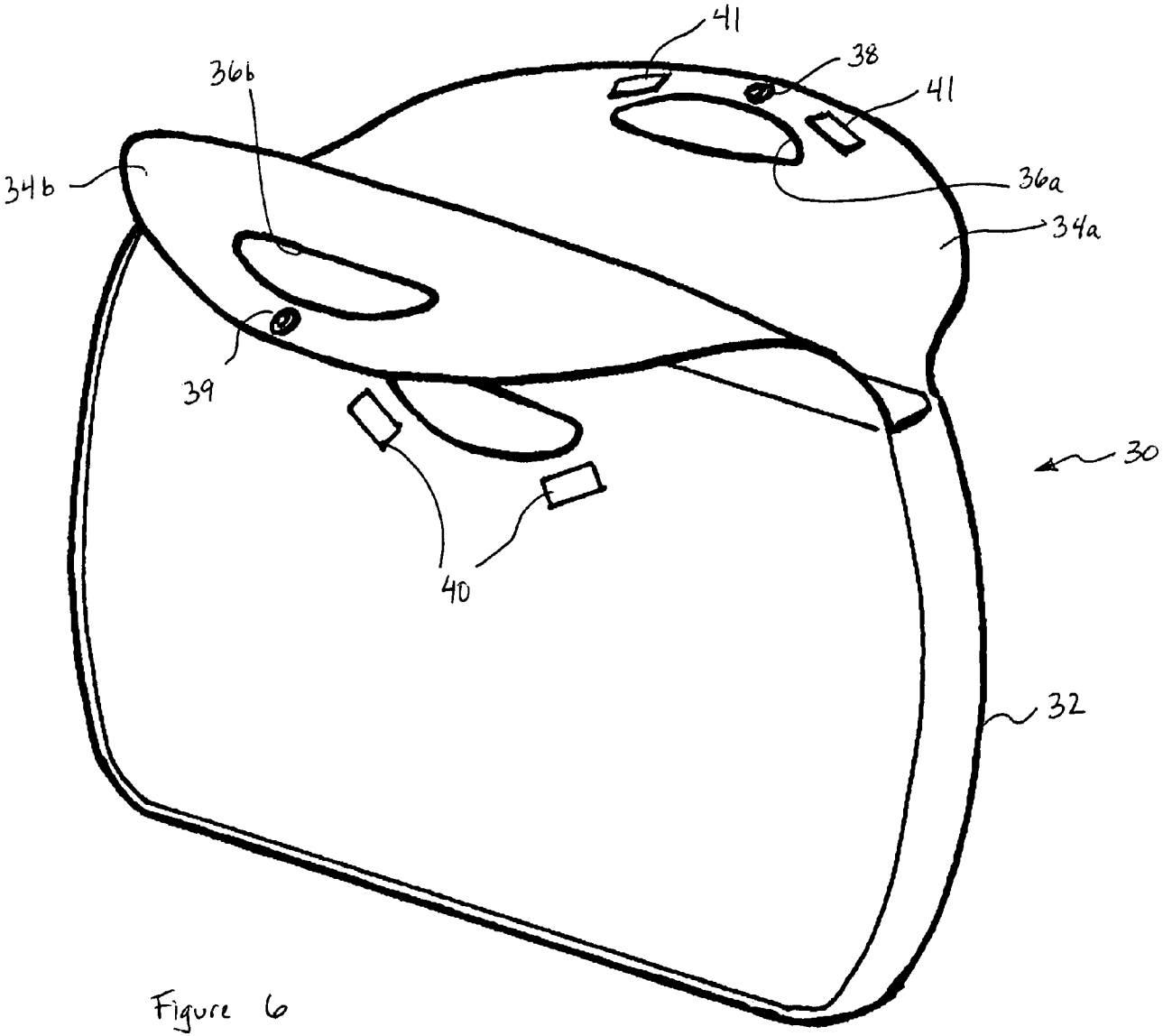
FIG. 6 is a perspective view of a convertible bag according to a second embodiment of the present invention. The handles are positioned to illustrate two different sets of fasteners, one for securing the handles in the tote configuration and the other for securing the handles in the sleeve configuration.

Referring now to FIG. 6, according to a second embodiment the bag 30 is shown in its conversion from the tote configuration to the sleeve configuration. The bag 30 includes a body 32, handles 34*a*, 34*b* (with openings 36*a*, 36*b*) as described in connection with the embodiment shown in FIGS. 1-4, and four fasteners 38, 39, 40, and 41. Fasteners 38 and 39 are connected to the handles 34*a*, 34*b*, respectively, such that they engage one another to secure the handles in the first position (i.e., tote configuration) with the two handles confronting one another and openings 36*a*, 36*b* aligned to receive a user's hand. Fasteners 40 are connected externally of body 32 and fasteners 41 are connected to handle 34*a* such that fasteners 40 and 41 engage one another to secure the handles in the second position (i.e., sleeve configuration). In the second position, the openings 36*a*, 36*b* are obstructed.

The conversion of bag 30 from the first position to the second position is consistent with the description above with regard to bag 10. The only difference is that handle 34*a* has two fasteners 38 and 41 rather than one. Fastener 38 mates with fastener 39 only when the handles are in the first position, and fastener 41 mates with fastener 40 only when the handles are in the second position. Thus, fasteners 38 and 40 are incapable of mating engagement, either due to their position or to the type of fastener that is utilized.

In this embodiment, fasteners 38 and 39 can be the same type of fastener pair as fasteners 40 and 41, or they can be different. If the fastener pairs are different from one another, e.g., fasteners 38 and 39 are male/female snap fasteners, respectively, while fasteners 40 and 41 are magnetic fasteners, respectively, then fasteners 38 and 41 can be located either at the same general site on handle 34*a* or at different locations. The latter is illustrated in FIG. 6.

As shown in the accompanying figures, in the first configuration (i.e., tote configuration) the computer bag has the appearance of a conventional tote bag and can be carried as such given the confronting alignment of handles. This configuration is desirable for persons who have little need to carry their laptop with additional accessories or documents. In the second configuration (i.e., in the "sleeve" configuration), the computer bag can be used to protect a laptop inside another bag. This configuration is desirable for persons who intend to carry their laptop in a larger bag, in which case the sleeve will protect the computer from damage that may be caused by books or other accessories also contained in the larger bag.

The convertible bag of the present invention converts from the tote position to the sleeve position (and back again) in a fluid and simple motion: the second handle is tucked between a laptop and the opposite body panel of the bag, and then the first handle is folded over the second handle and externally of the opposite body panel of the bag. To convert the bag from sleeve position to tote position, the opposite manipulation can be performed.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A convertible bag for carrying a laptop, the bag comprising:

a body that has first and second body panels that are joined together, and has an opening along one edge thereof;

a first handle panel connected to the first body panel adjacent the opening and a second handle panel connected to the second body panel adjacent the opening, the first handle panel extending substantially the entire length of the opening and each handle panel defining an aperture, the first and second handle panels being adjustable between a first position with the apertures of the first and second handle panels aligned and a second position with the second handle panel inserted into the opening of the body and the first handle panel folded over the second handle panel to cover the opening to the body and contact the second body panel; and at least three fasteners, one fastener attached to each handle panel and one fastener attached to the second body panel, whereby two or more of the at least three fasteners are positioned to engage one another when (i) the first and second handle panels are in the first position and (ii) the first and second handle panels are in the second position;

whereby two or more of the at least three fasteners can retain the first and second handle panels in either the first or second position.

2. The convertible bag according to claim 1, wherein the at least three fasteners comprise:

a first fastener attached to the first handle panel, a second fastener attached to the second handle panel, wherein the first and second fasteners are attached to confronting surfaces of the first and second handle panels, respectively, to allow for mating engagement of the first and second fasteners when the first and second handle panels are in the first position, and a third fastener attached to an external surface of the second body panel to allow for mating engagement of the first and third fasteners when the first and second handle panels are in the second position.

3. The convertible bag according to claim 2, wherein the second and third fasteners are the same type of fastener.

4. The convertible bag according to claim 2, wherein the first fastener is a hook or loop fastener, a magnetic fastener, or a male or female snap fastener.

5. The convertible bag according to claim 1, wherein the at least three fasteners comprise:

a first fastener attached to the first handle panel, a second fastener attached to the second handle panel, wherein the first and second fasteners are attached to confronting surfaces of the first and second handle panels, respectively, to allow for mating engagement of the first and second fasteners when the first and second handle panels are in the first position, a third fastener attached to the first handle panel, and a fourth fastener attached to an external surface of the second body panel to allow for mating engagement of the third and fourth fasteners when the the first and second handle panels are in the second position.

6. The convertible bag according to claim 5, wherein the first and second fasteners are a different type of fastener as compared to the third and fourth fasteners.

7. The convertible bag according to claim 6, wherein the first and third fasteners occupy a common site on the first handle panel.

8. The convertible bag according to claim 5, wherein the first and second fasteners are the same type of fastener as compared to the third and fourth fasteners.

9. The convertible bag according to claim 8, wherein the first and third fasteners each occupy a distinct site on the first handle panel, whereby the first fastener cannot mate with the fourth fastener when the handles are in the second position and the third fastener cannot mate with the second fastener when the handles are in the first position.

10. The convertible bag according to claim 5, wherein the first and third fasteners are independently a hook or loop fastener, a magnetic fastener, or a male or female snap fastener.

* * * * *